United States Patent [19]

Mizuta et al.

[11] Patent Number: 4,491,049

[45] Date of Patent: Jan. 1, 1985

[54] ELECTRONIC MUSICAL INSTRUMENT

[75] Inventors: Takemi Mizuta, Osaka; Tomohiro Inoue, Nara, both of Japan

[73] Assignee: Sharp Kabushiki Kaisha, Osaka, Japan

[21] Appl. No.: 333,694

[22] Filed: Dec. 23, 1981

[30] Foreign Application Priority Data

| | | | |
|---|---|---|---|
| Dec. 23, 1980 | [JP] | Japan | 55-184916 |
| Dec. 23, 1980 | [JP] | Japan | 55-184917 |
| Jan. 17, 1981 | [JP] | Japan | 56-5393 |
| Jan. 19, 1981 | [JP] | Japan | 56-6778 |
| Jan. 19, 1981 | [JP] | Japan | 56-6779 |

[51] Int. Cl.[3] ..... G10H 7/00

[52] U.S. Cl. ..... 84/1.01; 84/1.28; 84/478; 340/384 E; 364/705; 364/709; 364/710; 368/10; 368/72; 368/245; 368/251; 368/272; 368/274

[58] Field of Search ..... 84/1.01, 1.03, 1.27, 84/1.28, 1.24, 477 R, 478; 340/384 R, 384 E; 368/10, 72–75, 155, 156, 244, 250, 251, 245, 272–274; 364/705, 709, 710

[56] References Cited

U.S. PATENT DOCUMENTS

| | | | |
|---|---|---|---|
| 3,955,459 | 5/1976 | Mochida et al. | 84/1.01 |
| 4,046,047 | 9/1977 | Roberts | 84/1.01 |
| 4,080,862 | 3/1978 | Hiyoshi et al. | 84/1.03 X |
| 4,090,349 | 5/1978 | Takase | 84/1.01 X |
| 4,179,972 | 12/1979 | Hiyoshi et al. | 84/1.01 X |
| 4,185,531 | 1/1980 | Oberheim et al. | 84/1.28 X |
| 4,198,892 | 4/1980 | Gross | 84/1.24 |
| 4,238,985 | 12/1980 | Adachi | 84/1.01 |
| 4,267,586 | 5/1981 | Uchino et al. | 368/73 |
| 4,282,790 | 8/1981 | Wachi | 84/1.27 X |
| 4,323,995 | 4/1982 | Chiu | 368/75 |
| 4,326,276 | 4/1982 | Scott, Jr. | 368/10 |
| 4,364,299 | 12/1982 | Nakada et al. | 84/478 |
| 4,368,989 | 1/1983 | Kawashima | 368/74 |

*Primary Examiner*—S. J. Witkowski

*Attorney, Agent, or Firm*—Birch, Stewart, Kolasch and Birch

[57] ABSTRACT

An electronic musical instrument having key input means selectively actuable to cause the production of sounds corresponding to respective notes of the musical scale, comprises a memory circuit for storing the respective notes, and a clear circuit actuated to partially amend at least one of the notes from the contents of the memory means.

8 Claims, 19 Drawing Figures

ELECTRONIC MUSICAL INSTRUMENT

BACKGROUND OF THE INVENTION

The present invention relates to a musical instrument and, more particularly, to an electronic musical instrument for inputting and playing a particular melody by key input operations.

Conventional electronic musical instruments are equipped with key switches for inputting particular notes and rests in coded information. The coded information is stored in a memory. In these electronic musical instruments, preferably, the inputted note/rest information can be amended even by going tc the past.

However, such a kind of electronic musical instrument is absent so that it is desired to provide this type of instrument.

SUMMARY OF THE INVENTION

Accordingly, it is an object of the present invention to provide an improved electronic musical instrument for amending inputted note/rest code information, by going to the past, in a particular melody.

It is another object of the present invention to provide an improved electronic musical instrument for amending note pitch information and/or note duration information while an inputted and memorized melody is played.

It is a further object of the present invention to provide an improved electronic musical instrument for shifting an octave of a musical scale where a particular melody is played by note information/rest information inputted by key switches.

It is a further object of the present invention to provide an improved electronic musical instrument for compressing stored note information/rest information forming a particular melody.

It is a further object of the present invention to provide an improved combined electronic musical instrument and electronic timepiece for selecting and alarming a fixed melody stored in a memory and a voluntary melody entered by key input operations.

Briefly described, in accordance with the present invention, an electronic musical instrument having key input means selectively actuable to cause the production of sounds corresponding to respective notes of the musical scale, comprises memory means for storing the respective notes, and clear means actuated to partially amend at least one of the notes from the contents of the memory means.

BRIEF DESCRIPTION OF THE DRAWINGS

The present invention will become more fully understood from the detailed description given hereinbelow and the accompanying drawings which are given by way of illustration only, and thus are not limitative of the present invention and wherein.

DESCRIPTION OF THE INVENTION

Figure 1:
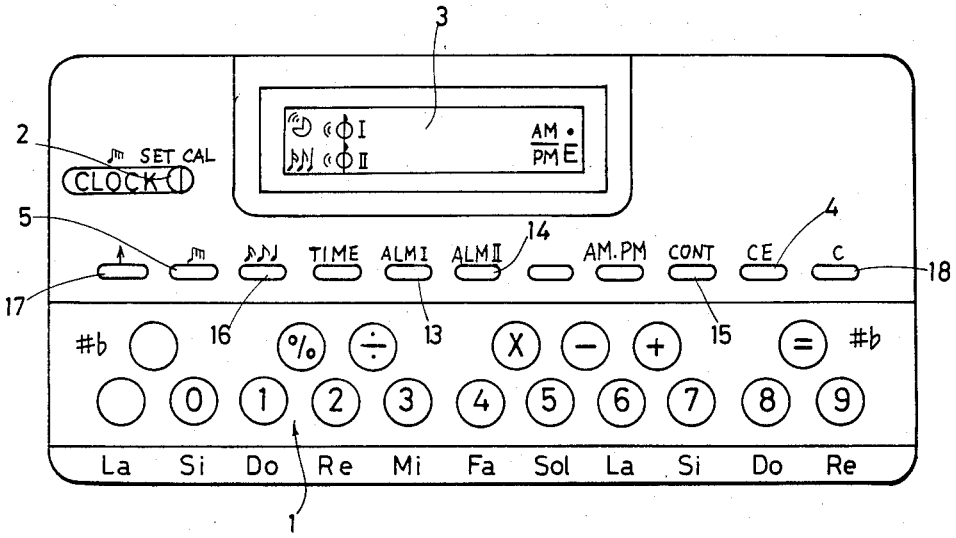
FIG. 1 shows a front view of an electronic combined device functioning as an electronic musical instrument, an electronic calculator and an electronic timepiece according to the present invention.

FIG. 1 shows a front view of an electronic combined device functioning as an electronic musical instrument, an electronic calculator and an electronic timepiece according to the present invention.

The combined device comprises 18 note key switches 1 in a pianoforte keyboard. A mode selector 2 is actuated to select the electronic musical instrument mode, the electronic calculator mode and the electronic timepiece mode. As long as the mode selector 2 is placed in a playing mode, referred to "♪" in the electronic musical instrument mode, a melody can be played by actuating each of the note key switches 1. For example, "Do" is played by actuating a numeral "1" key switch and "Do#" is played by actuating a "%" key switch.

In the electronic musical instrument mode, the order of the actuation of the respective note key switches and, the time when one of these key switches is actuated and none of them is actuated are memorized as a melody as will be described below.

A voluntary melody can be memorized in a set mode referred to "SET". While this set mode is selected and a play key switch 5 is actuated, voluntary melody can be memorized as an alarming. melody which is to be developed for an alarm time.

For setting an alarm time, a first alarm key switch 13 and a second alarm key 14 are provided either of which is actuated. When the first alarm key switch 13 is actuated, a voluntary melody which can be memorized by the key input operations of the switches 1 is delivered when it is the alarm time. When the second alarm key switch 14 is actuated, a fixed melody already memorized is delivered when it is the alarm time.

A clear key 18 is actuated to cancel a voluntary melody newly memorized by the key input operations. Together with actuating any one of the note key switches 1 in the playing mode of the electronic musical instrument mode, an octave key switch 17 is actuated to raise one octave in pitch above an octave preset for the note key switches 1. A clear entry key switch 4 is actuated to amend part of the voluntary melody. A play key switch 5 is actuated to automatically play the voluntary melody entered by the key input operations.

When the melody memorized is played and a pitch of a particular note is wrong, a corrected one of the note key switches 1 and a control key switch 15 are successively actuated to amend the pitch. When a duration of a note or a rest is wrong, a rhythm key switch 16 is actuated to amend the duration.

A display 3 displays time information during the electronic musical instrument mode.

Figure 2:
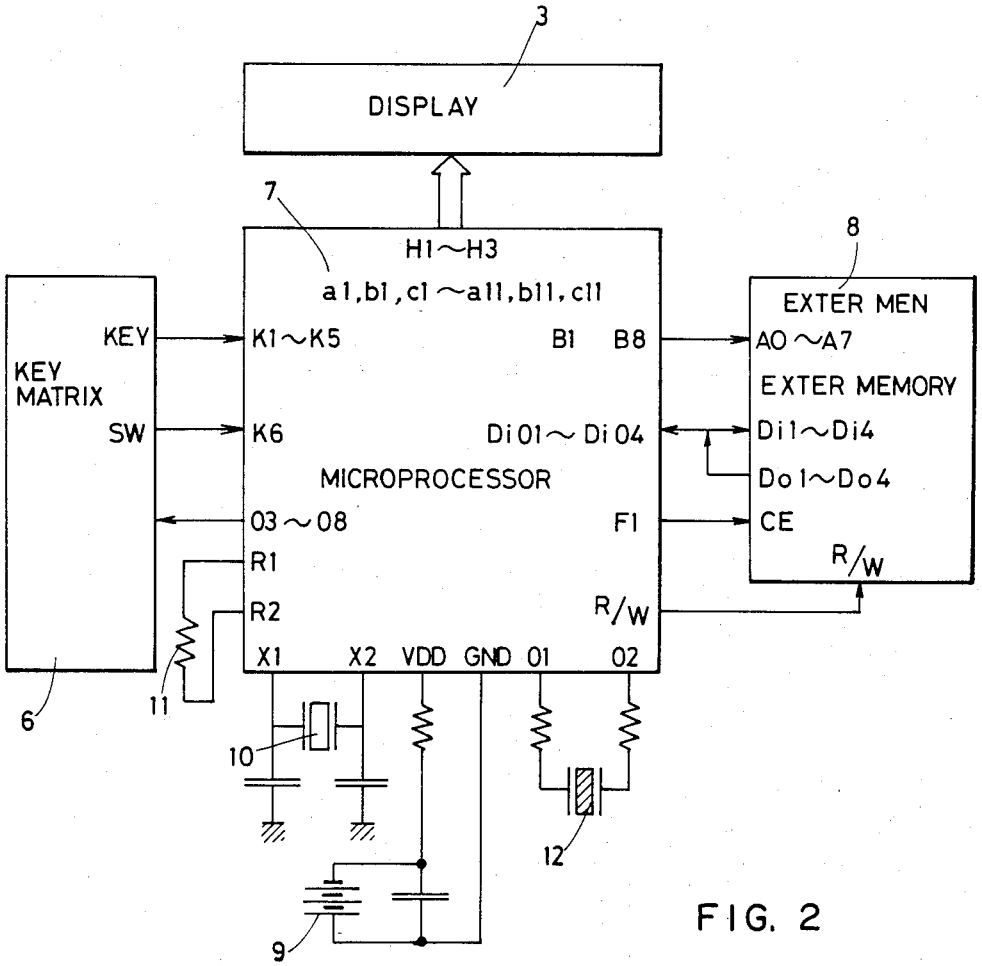
FIG. 2 shows a block diagram of a circuit implemented within the instrument of FIG. 1.

FIG. 2 shows a block diagram of a circuit for playing a melody in the electronic musical instrument. The circuit comprises the display 3, a key matrix 6 inclusive of the above described various key switches 1, 2, 4, 5 and 13 to 18, a microprocessor 7, an external memory 8, a power source 9, a crystal oscillator 10, a resistor 11, and a speaker 12.

The microprocessor 7 outputs key strobe signals to the key matrix 6 through terminals 03 to 08. The key matrix 6 is responsive to the key strobe signals for developing key return signals through terminals KEY and SW to terminals $K_1$ to $K_6$ of the microprocessor 7 so as to read in key input signals. The display 3 preferably comprises a liquid crystal dipslay. The microprocessor 7 outputs back plate signals to the display 3 through terminals $H_1$ to $H_3$ and segment selection signals to the display 3 through the terminals a1, b1, c1 to a11, b11, c11.

The microprocessor 7 outputs address signals toward input terminals A0 to A7 of the external memory 8 through output terminals B1 to B8. Data can be transferred between the terminals Di01 to Di04 of the microprocessor 7 and the terminals Di1 to Di4 and D01 to D04 of the external memory 8 in both directions. Chip selection signals are applied from the terminal F1 of the microprocessor 7 to the terminal CE of the external memory 8. Read/write signals are introduced from the terminal R/W of the microprocessor 7 to the terminal R/W of the external memory 8.

The power source 9 is coupled between the terminals VDD and GND of the microprocessor 7. The crystal oscillator 10 is coupled between the terminals X1 and X2. The resistor 11 is connected between the terminals R1 and R2 for oscillating a clock generator CG1 as described in FIG. 3. The speaker 12 is connected between the terminals 01 and 02 for oscillating in response to the note signals output by the terminals 01 and 02 so as to sound.

Figure 3:
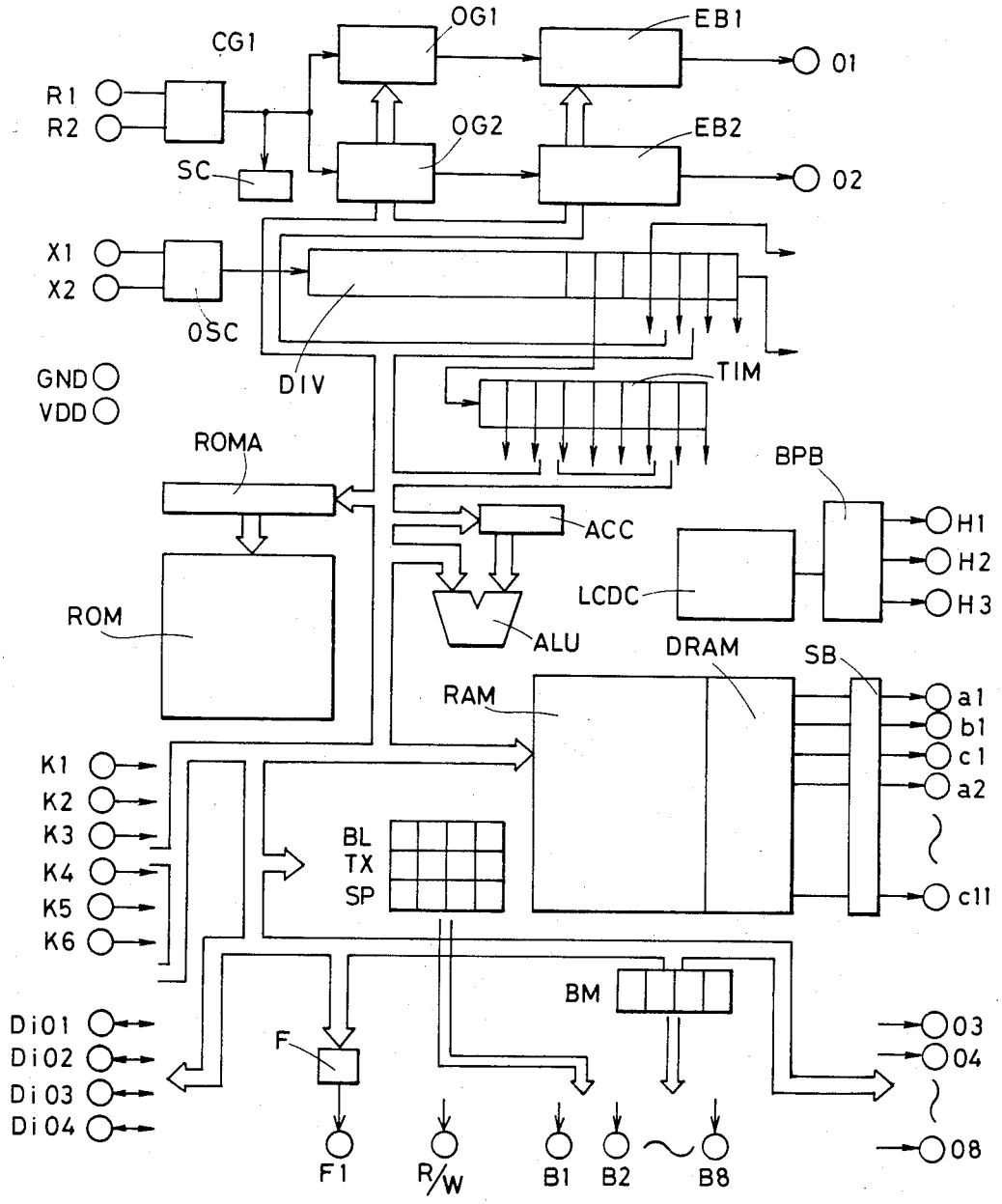
FIG. 3 shows a block diagram of a microprocessor connected in the circuit of FIG. 2.

FIG. 3 shows a block diagram of the microprocessor 7 of FIG. 2. Clock pulse signals from the clock generator CG1 are applied to note generators OG1, OG2 and a system clock generator SC. Each of the note generators OG1 and OG2 is responsive to the input of the note code signals for dividing the clock pulse signals from the clock generator CG1 and for outputting note signals toward each of two envelop buffers EB1 and EB2. Each of the buffers EB1 and EB2 controls the enveloping amplitude of the note signals by amplitude information to output the resulting signals through terminals 01 and 02.

Figure 4:
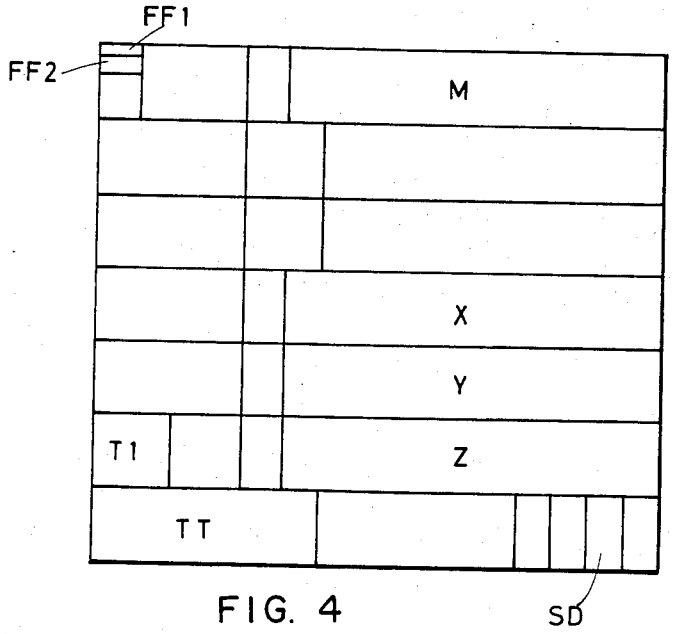
FIG. 4 snows inner circuits of a RAM provided in the microprocessor of FIG. 3.

A frequency devider DIV divides an oscillation frequency from a reference frequency oscillator OSC so as to output "1" second signals useful for operating as the electronic timepiece. Further, "32" Hz signals are generated from the divider DIV to a timer circuit TIM for counting. The timer TIM continues to count unless it is reset by instructions. Reading the output from the timer TIM provides time information from a time in resetting the timer TIM to another time in reading. This type of time information is used to define the actuated duration on one of the note key switches 1, the non-actuated duration on these switches 1 and the note output in playing the notes. A ROM stores instruction codes for operating the microprocessor 7. A RAM functions as various registers and flags. FIG. 4 shows inner circuits of the RAM comprising registers X,Y,Z, and M for calculation or a memory, a register TT for storing a current time of hour information, minute information, and second information occupying 6 digits intotal, a register T1 for storing the note duration data and the rest duration data (5 bits) occupying 16 bits in total, and two flags FF1 and FF2.

Turning back to FIG. 3, in a displaying memory DRAM the respective bits correspond to the respective liquid crystal segments. When decoded information is set in the memory DRAM, the segment selection signals are applied to the liquid crystal segments through a segment buffer SB. There are further connected an accumulator ACC, a calculation logic operation circuit ALU, an address counter ROMA for the ROM, an output buffer BPB for outputting the back plate signals from a liquid crystal display driver LCDC, a digit address counter BL for the RAM and the DRAM, a file address counter BM for the RAM and the DRAM, a temporary register TX, a stack pointer SP, and an output buffer F.

Figure 5:
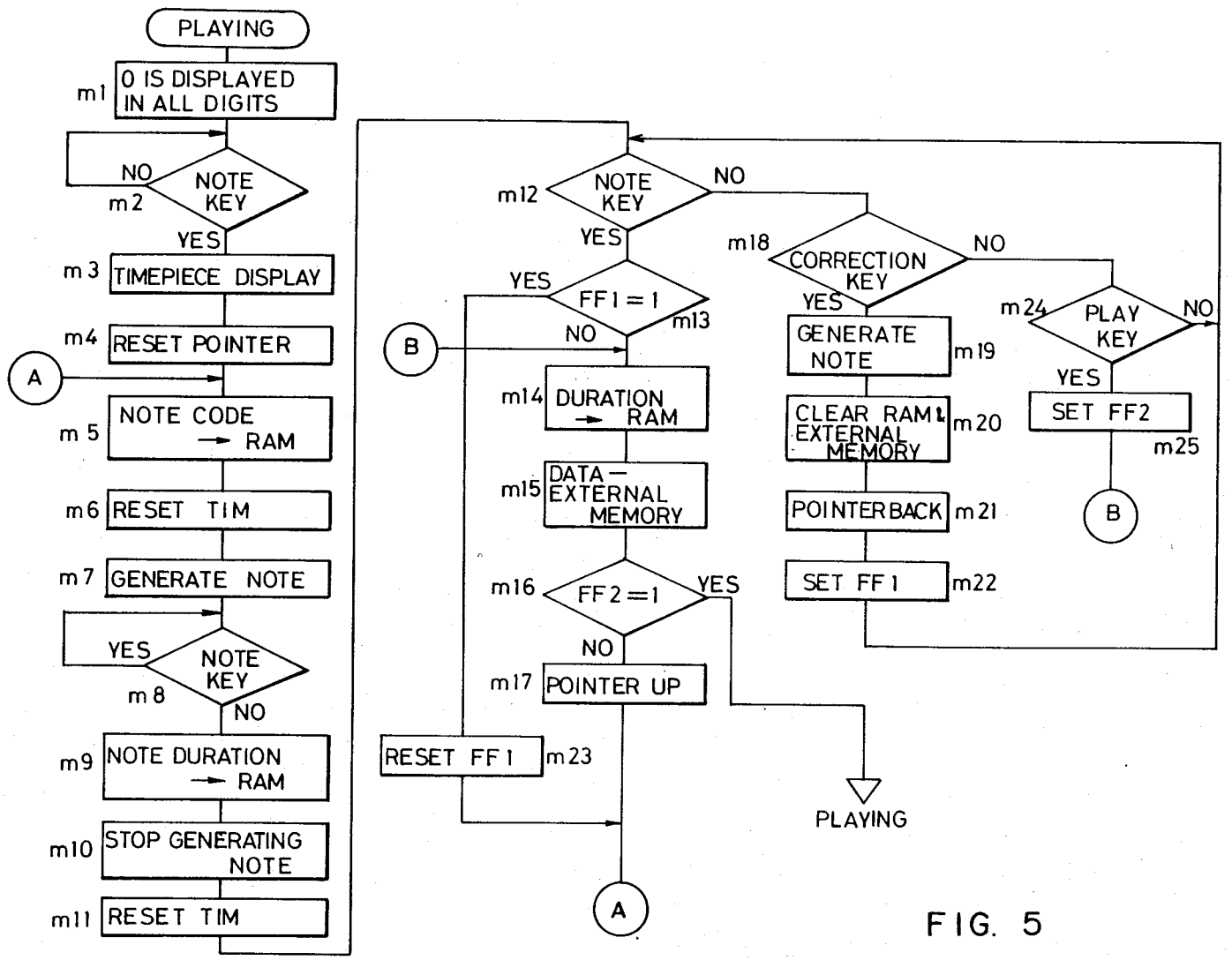

Each of operations according to the present invention is as follows:

(1) Musical information inputted by the key input operations can be amended by going back to the past:

In FIG. 5, the mode selector 2 is placed at the playing mode of the electronic musical instrument mode to provide the following steps.

Step m1: "0" is displayed in all digits of the display 3, which indicates the selection of the playing mode.

Step m2: one of the note key switches 1 is actuated.

Step m3: The timepiece display is indicated in the display 3. This means the beginning of playing.

Step m4: A pointer for storing an address when the external memory 8 stores the musical information at the address is reset. As the pointer is reset, the musical information is stored in the external memory 8 from the head address to the following address, in order.

Step m5: A note code corresponding to one of the note key switches 1 actuated is entered to a buffer of the RAM.

Step m6: the timer T1M is reset.

Step m7: Each of the note generators OG1 and OG2 receives the note code to output a corresponding note.

Stem m8: The actuation of the one of the note key switches 1 is terminated.

Step m9: The output from the timer TIM at this time is entered to the note duration buffer in the RAM.

Step m10: As soon as the actuated time of the one of the note key switches 1 is entered into the RAM, the note generation is terminated. The generation and the prohibition of the note in step m10 are carried out by entering generation codes or prohibition codes into the envelope buffers EB1 and EB2 functioning to control the strength of the note outputted, primarily. But, they are used to control the generation and the prohibition of the note at this time.

Step m11: The timer TIM is reset to count the rest duration data before one of the note key switches 1.

Step m12: A next note key switch 1 is actuated.

Step m13: The condition of the flag FF1 in the RAMam is detected.

Step m14: When FF1=0, step m14 is selected. The output value from the timer TIM at this time is entered into the rest duration buffer in the RAM. Then, three types of data inclusive of the note code, the note duration and the reset duration are supplied.

Step m15: These three types of data are transferred into the external memory 8.

Step m16: It is detected whether FF2=0 or not.

Step m17: The pointer is advanced by one for the following data transference.

Step m5: The note code corresponding to the one of the note key switches 1 actuated is entered into the buffer in the RAM.

Thereafter, steps m5 to m17 are repeated to play.

It is assumed that the clear entry key 4(correction key) is actuated during playing. In such a case, each of the operations is as follows:

Step m18: It is detected whether the clear entry (correction) key switch 4 is actuated. When it is actuated, step m19 is selected.

Step m19: A note corresponding to the just preceding one of the note key switches 1 is played.

Step m20: The data of the note code, the note duration and the reset duration in the buffers in the RAM are canceled. The data of the note code, the note duration and the reset duration in the external memory 8 are canceled. That is, the data from the actuation of the just preceding one of the note key switches 1 before the actuation of the clear entry key 4 are canceled.

Step m21: The pointer is decreased by one to play any correct note.

Step m22: The flag FF1 is set for indicating the actuation of the clear entry key x.

Step m12: Any correct one of the note key switches 1 is actuated to select steps m13 and m23 where the flag FF1 is reset.

Step m5: This step is re-selected where the note code is entered into the buffer of the RAM. The above operation is carried out.

To amend the note/reset data positioned at two or more preceding notes, the clear entry key 4 is actuated at the number of preceding. Then, in step m21, the pointer is decreased one by one at the number of preceding to cancel the wrong note code, the wrong note duration and the wrong reset duration.

In this manner, the inputted melody is memorized simultaneously with the key input operations. To play the inputted melody, the play key switch 5 is operated.

Step m24: It is detected whether the play key 5 is actuated or not. When it is actuated, step m25 is selected.

Step m25: The flag FF2 is set.

Steps m14 to m16: The memorized melody is played.

Figure 6:
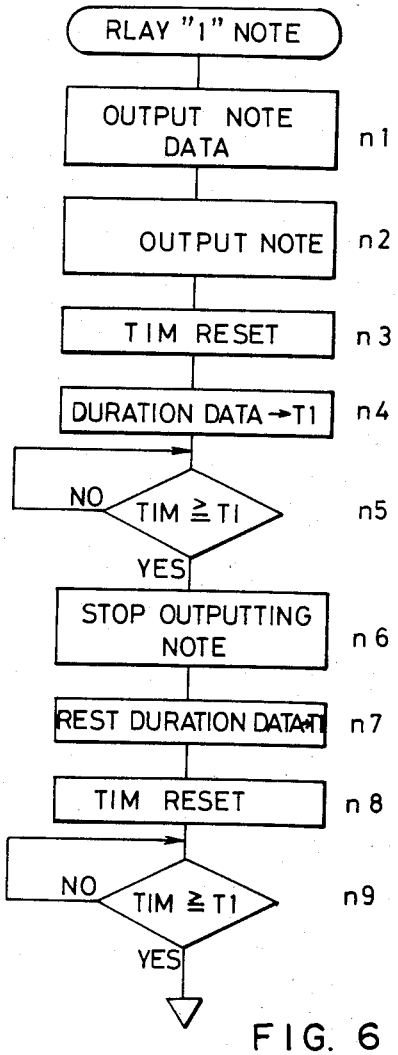
FIGS. 5 to 7(1) 7(2) and 7(3) show a flow chart of operations according to the present inventicn.

FIG. 6 shows a flow chart for describing the playing operation. The musical information stored in the external memory 8 is read out subsequently from the head to play each of the notes.

Step n1: The note data are applied into the note generators OG1 and OG2 so that the note generation start instructions are entered into the envelope buffers EB1 and EB2.

Step n2: The note of the note data is generated.

Step n3: The timer TIM is reset

Step n4: The note duration is entered into the register T1.

Step n5: The output from the timer TIM and the note data from the register T1 are compared in length. When they agree where the note continues to play for the time corresponding to the note duration, step n6 is selected.

Step n6: Note generation prohibition instruction are entered into the envelope buffers EB1 and EB2 to stop the note play.

Step n7: The rest duration data is entered into the register T1.

step n8: The timer TIM is reset. Step n9: The output from the timer TIM and the rest duration data are compared to detect whether the play stops for the time corresponding to the rest duration data.

Thus, the operation for playing a note is repeated to play the melody.

(2) Any pitch information and any duration information of a note can be amended while the note to be amended is played.

Figure 7:
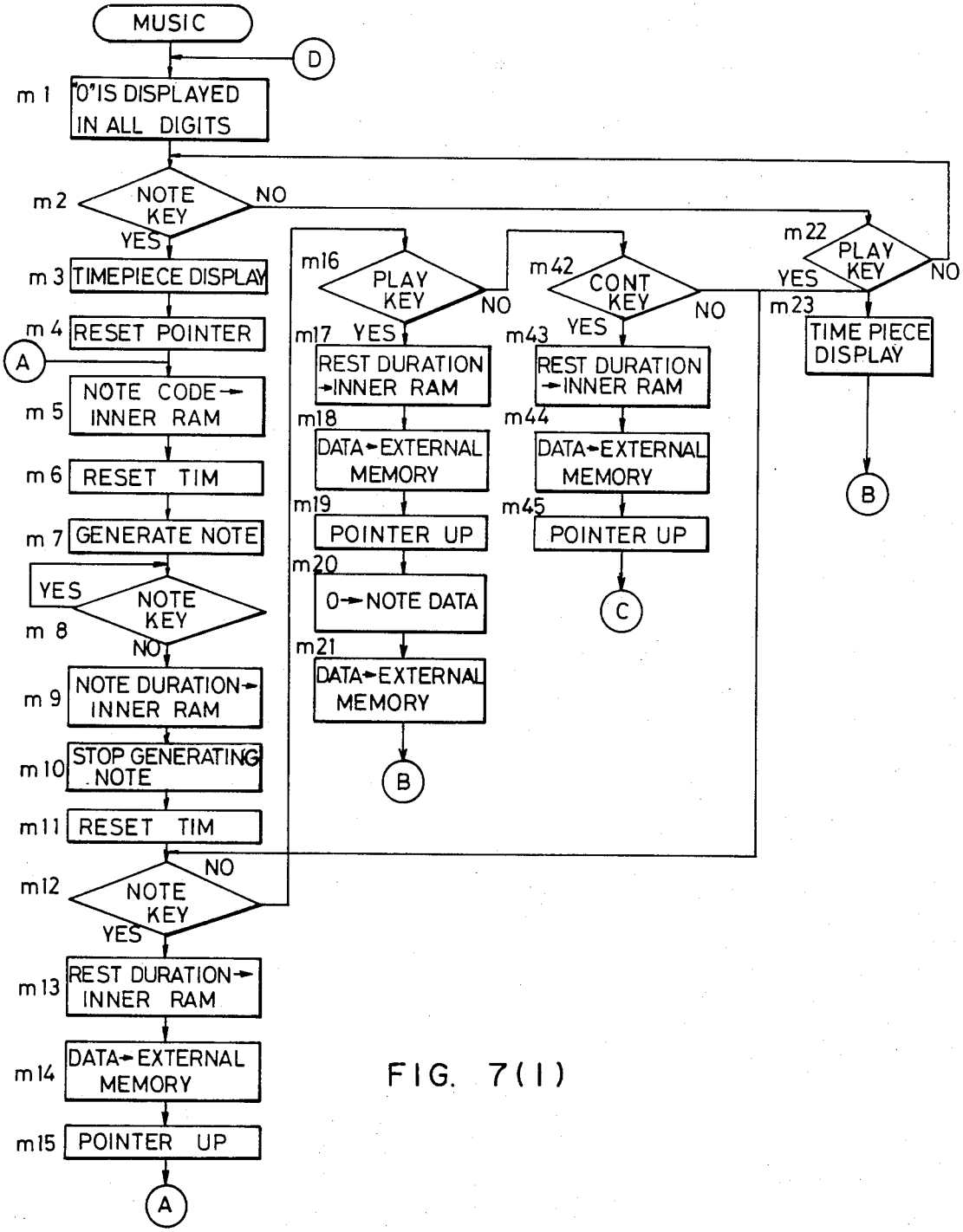
Figure 7:
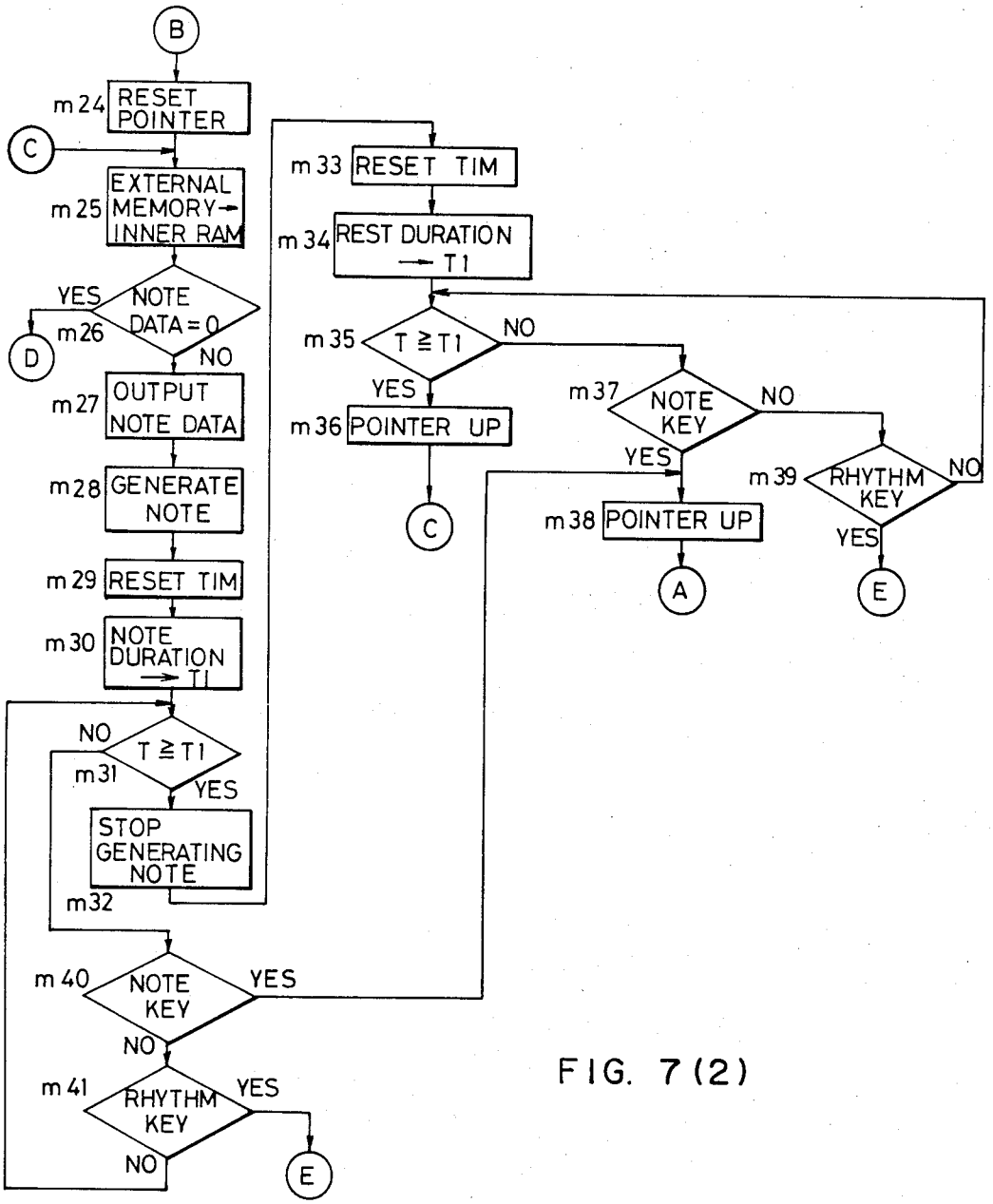
Figure 7:
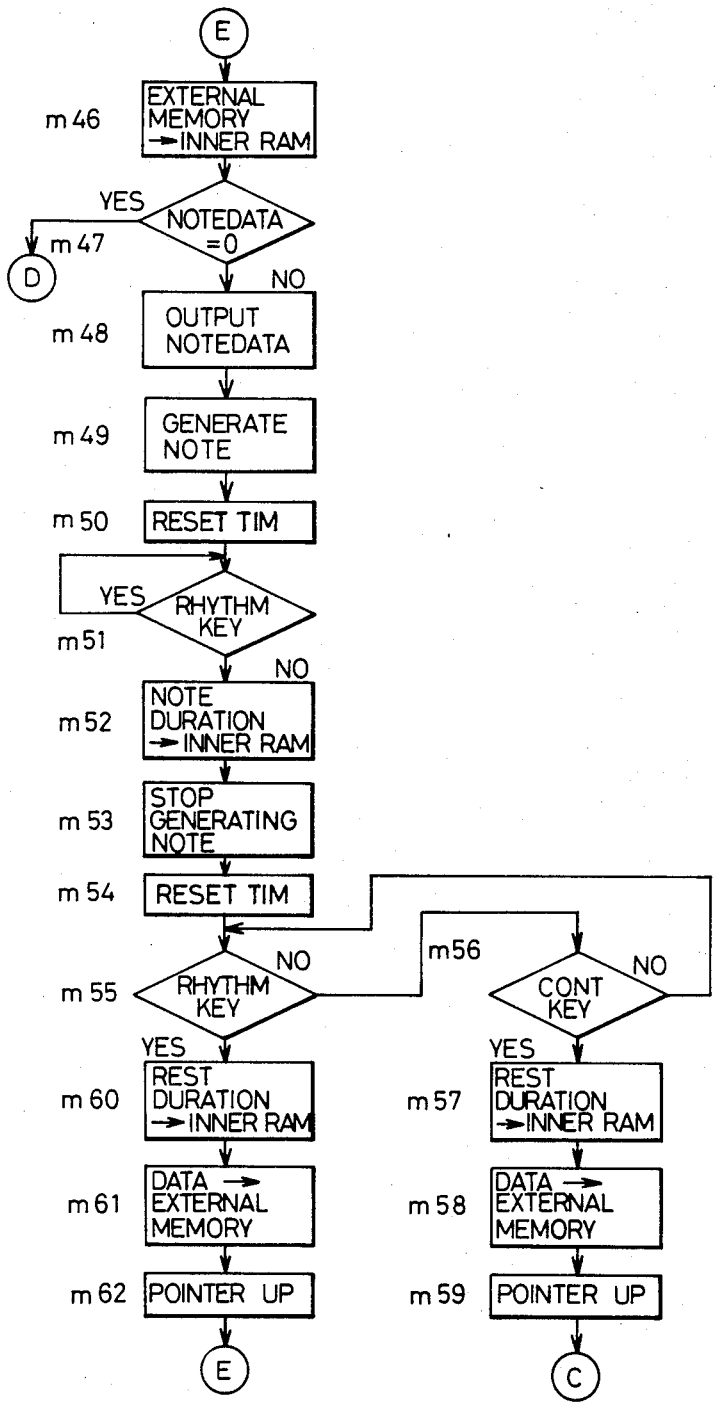

FIGS. 7(1) to 7(3) show a flow chart for this operation. The mode selector 2 is placed in the playing mode of the electronic musical instrument mode.

Steps m1 to m12 in the flow chart of FIG. 7(1) are identical to steps m1 to m12 in the flow chart of FIG. 5.

Step m13: The output from the timer TIM is entered into the rest duration buffer of the RAM. This indicates that three kinds of data inclusive of the note code, the note duration and the rest duration are supplied.

Step m14: The three kinds of data are transferred into the external memory 8.

Step m15: The pointer is advanced by one for the following data transference.

Step m5: The note code corresponding to the one of the note key switches 1 actuated is entered into the buffer of the RAM.

Step m5 to m15 are repeated to play.

Step m16: After the full-melody is inputted by the key input operations, the play key 5 is actuated to select this step.

Step m17: The output from the timer TIM is inputted into the rest duration buffer of the RAM as the rest duration data.

Step m18: All of the note code data, the note duration data and the rest code data are transferred into the external memory 8.

Step m19: The pointer is advanced by one.

Step m20: The note code becomes "0" as END code.

Step m21: All of the data are transferred into the external memory 8.

Thereafter, the program is led into the playing operation as shown in the flow chart of FIG. 7(2).

Step m24: The pointer is reset to select the head of the melody stored in the external memory 8.

Step m25: The head data of the melody specified in step m24 is the buffer of the RAM.

Step m26: It is detected whether the note code to be transferred is "0" or not. When it is not "0", step m27 is selected.

Step m27: The note data are applied to the note generators OG1 and OG2.

Step m28: The note corresponding to the note code is played.

Step m29: The timer TIM is reset.

Step m30: The note duration data is transferred into the register T1.

Step m31: The output T from the timer TIM and the value in the register T1 are compared. When they agree, this indicates that the note continues to play for the time corresponding to the note duration data.

Step m32: The note generation is terminated.

Step m33: The timer TIM is reset

Step m34: The rest duration data is transferred into the register T1.

Step m35: The output T from the timer TIM and the value in the register T1 are compared. When they agree, this indicates that the note is rested for the time corresponding to the reset duration data.

Step m36: The pointer is advanced by one.

Step m25 is re-selected and, thereafter, steps m25 to m36 are repeated to play the melody.

The pitch information of any note can be amended by the following manner while the note to be amended is played.

To input a corrected note with one of the note key switches 1 when any appropriate note is not generated, steps m35 and m37 are selected to lead to step m38 in which the pointer is advanced by one. Therefore, step m5 in FIG. 7(1) is selected where the note code corresponding to the actuated one of the note key switches 1 is stored in the RAM. Steps m6 to m8 are specified. In step m9, the note duration data is transferred into the buffer in the RAM.

Thereafter, the control key 15 is actuated to play the remaining melody.

Steps m10→m11→m16→m42→m43: The buffer of the RAM receives the time information from the non-actuation of one of the note key switches 1 to the actuation of the control key 1, the time information being the rest duration data.

Step m44: The respective data are transferred into the external memory 8.

Step m45: The pointer is advanced by one to play the remaining melody. Then, step m25 is re-selected to further play.

Thus, the pitch information of any note is amended while the note is being played. Thereafter, the melody continues.

The duration information of any note can be amended while the melody is played. The rhythm key 16 is actuated to amend the duration information during the period when the note to be amended is played. The program is selected from step m31 of FIG. 7(2) to steps m40 and m41 of FIG. 7(2), and finally to the flow chart of FIG. 7(3) where the note duration data are amended. In FIG. 7(3), the respective operations are as follows:

Step m46: The data of the note presently played are transferred from the external memory 8 into the RAM.

Steps m47→m48→m49 : The note is played again.

Step m50: The timer TIM is reset.

Step m51: It is detected whether the rhythm key 16 is actuated or not.

Step m52: The output from the timer at the time when the rhythm key 16 is non-actuated at step m51 is inputted into the buffer of the RAM.

Step m53: The note generation is terminated.

Step m54: The timer TIM is reset.

Step m57: Actuating the control key 15 passes steps m55 and m56 to select step m57. In step m57, the rest duration data defined by the interval from the non-actuation of the rhythm key 16 to the actuation of the control key 15 are inputted into the RAM.

Step m58: The respective data of the note are transferred into the external memory 8.

Step m59: The pointer is advanced by one.

Step m25 of FIG. 7(2): This step is re-selected to continues to play the remaining melody.

When the rhythm key 16 is actuated at step m55, steps m60→m61→m62 are specified where the respective data inclusive of the rest duration data are transferred into the external memory 8. Step m46 is re-selected where the note duration of the next note can be amended.

Thus, while any note is played, the pitch information, the duration information of the note, and the reset duration information can be corrected. The data stored in the external memory 8 are also corrected.

When the melody is re-played, the corrected melody can be played. For the re-playing purpose, steps m26(m47)→m1→m2 are specified and, finally, step m22 is specified where the play key 5 is actuated. Step m23 is executed to provide the timepiece display. Step m24 is specified to play the amended melody.

Figure 8:
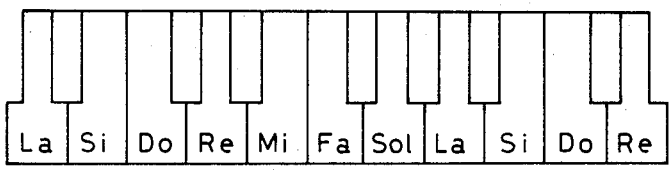
FIG. 8 shows an arrangement of part of a pianoforte keyboard.

(3) The octave of the musical scale where the notes can be played, can be shifted:

As stated in connection with FIG. 1, the note key switches 1 form the pianoforte keyboard as FIG. 8 shows. Each of note key switches 1 functions as a calculation key switch in the electronic calculator mode. The octave key switch 17 is actuated to raise one octave in pitch above a particular octave preset for the note key switches 1.

Figure 9:
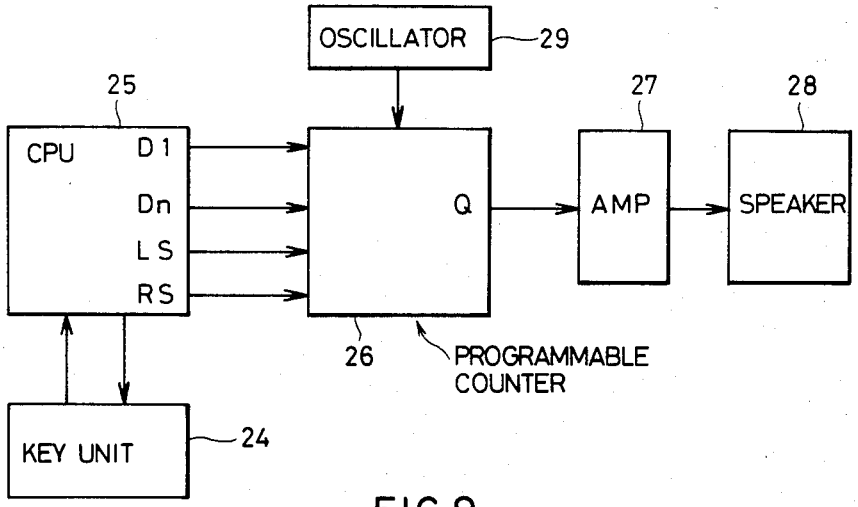
FIG. 9 shows a block diagram of a circuit for playing a particular melody according to the present invention.

FIG. 9 shows a block diagram of a playing circuit according to the present invention. The playing circuit comprises a key unit 24, a CPU 25, a programmable counter 26, an amplifier 27, a speaker 28, and an oscillator 29. The key unit 24 includes the 18 note key switches 1 and the octave key 17. The CPU 25 detects whether any of theses key switches 1 and 17 is actuated. The CPU 25 is responsive to the key input from the key unit 24 for providing frequency divided ratio data into the n-bits programmable counter 26. The counter 26 divides a reference frequency inputted from the oscillator 29 at the frequency divided ratio of the data to output sound source frequency. The amplifier 27 amplifies the sound source frequency to sound by the speaker 28.

The n-bits programmable counter 26 presets the n-bits frequency divided ratio data into a register within the counter 26 when a latch terminal LS of the CPU 25 outputs high level signals into the counter 26. When the signals inputted from a reset terminal RS of the CPU 25 below a low level, the contents of the register in the counter 26 are transferred into a counter in the counter 26. In response to clock signals from the oscillator 29, the counter in the counter 26 is counted down.

When the contents of the counter 26 are made "0", the n-bits programmable counter 26 converts the output level at an output terminal Q. The counter 26 transfers the contents of the register into the counter so that, in response to the clock signals from the oscillator 29, the counter is counted down. Thus, the sound source frequency is obtained whose frequency is defined by dividing the clock signals from the oscillator 29 by the n-bits frequency divided ratio.

Figure 10:
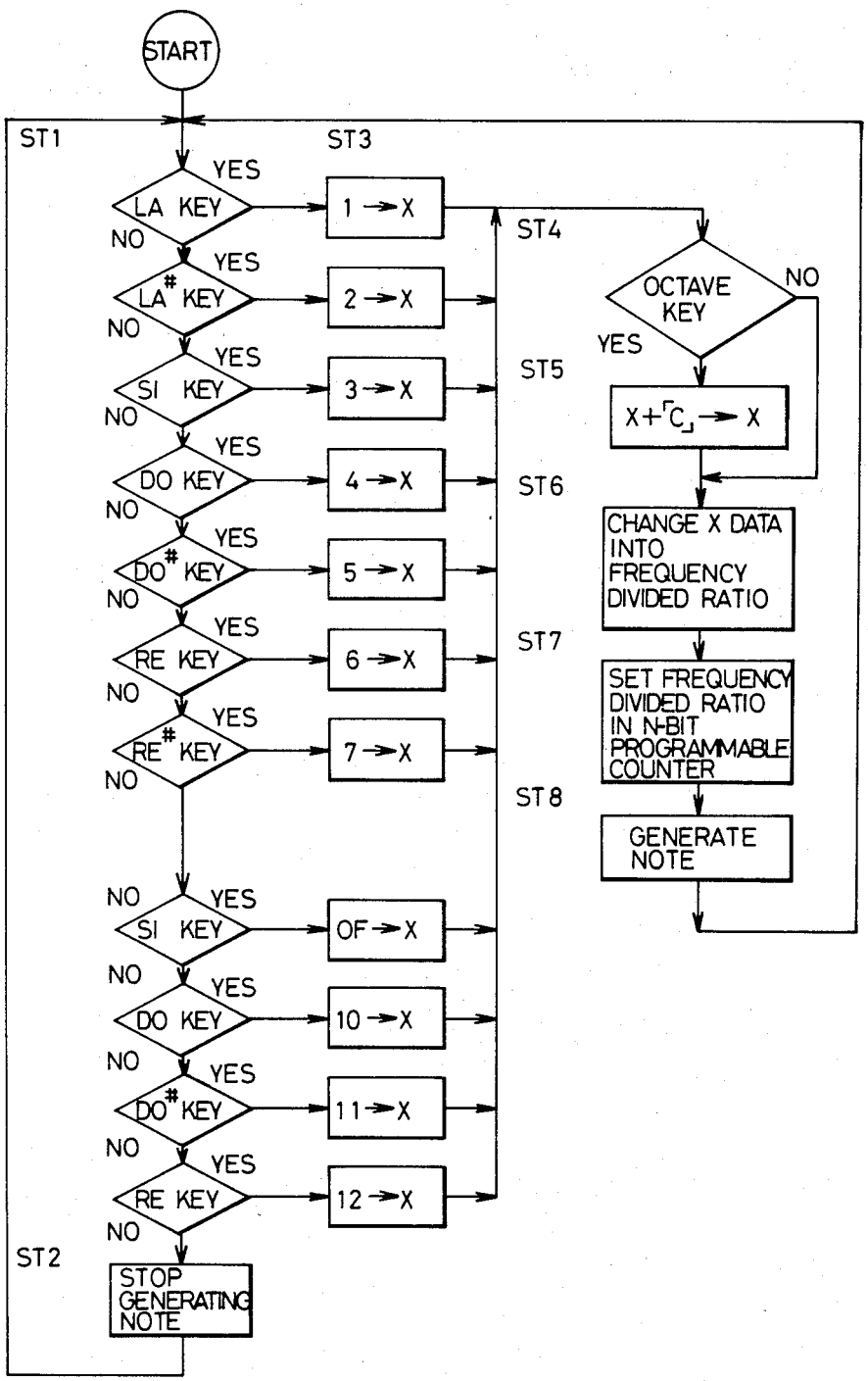
FIG. 10 shows a flow chart of an operation according to the present invention.

FIG. 10 shows a flow chart of the above operation.

Step ST1: The CPU 25 detects whether any one of the note key switches 1 is actuated.

Step ST2: When no one of the 18 note key switches 1 is actuated, step ST2 is selected so that the output level at the reset terminal RS of the CPU 25 becomes high and that the output level at the output terminal W of the programmable counter 26 becomes low. Then, the sound from the speaker 28 is terminated.

Step ST3: When any one of the 18 note key switches 1 is actuated, step ST3 is selected where the note data are introduced into the X register in the counter 26.

Step ST4: It is detected whether the octave key 17 is operated.

Step ST5: This step is selected when the octave key 17 is operated. "C" (hexadecimal notation) is added to the X register.

Step ST3: This step is selected when the octave key 17 is not operated. The contents of the X register are unchanged.

Step ST6: The contents of the X register are converted to the n-bits (8 bits in this example) frequency divided data. In case where the reference frequency of the oscillator 29 is assumed to be 210 KHz, the note data to be inputted into the XZ register in the counter 26 correspond to the frequency divided ratio data as Table 1 below shows.

TABLE 1

| register | frequency divided ratio | | binary | | | | | | | |
|---|---|---|---|---|---|---|---|---|---|---|
| | decimal | hexadecimal | D8 | D7 | D6 | D5 | D4 | D3 | D2 | D1 |
| 01 | 239 | EF | 1 | 1 | 1 | 0 | 1 | 1 | 1 | 1 |
| 02 | 225 | E1 | 1 | 1 | 1 | 0 | 0 | 0 | 0 | 1 |
| 03 | 213 | D5 | 1 | 1 | 0 | 1 | 0 | 1 | 0 | 1 |
| 04 | 201 | C9 | 1 | 1 | 0 | 0 | 1 | 0 | 0 | 1 |
| 05 | 189 | BD | 1 | 0 | 1 | 1 | 1 | 1 | 0 | 1 |
| 06 | 179 | B3 | 1 | 0 | 1 | 1 | 0 | 0 | 1 | 1 |
| 07 | 169 | A9 | 1 | 0 | 1 | 0 | 1 | 0 | 0 | 1 |
| 08 | 159 | 9F | 1 | 0 | 0 | 1 | 1 | 1 | 1 | 1 |
| 09 | 150 | 96 | 1 | 0 | 0 | 1 | 0 | 1 | 1 | 0 |
| 0A | 142 | 8E | 1 | 0 | 0 | 0 | 1 | 1 | 1 | 0 |
| 0B | 134 | 86 | 1 | 0 | 0 | 0 | 0 | 1 | 1 | 0 |
| 0C | 126 | 7E | 0 | 1 | 1 | 1 | 1 | 1 | 1 | 0 |
| 0D | 119 | 77 | 0 | 1 | 1 | 1 | 0 | 1 | 1 | 1 |
| 0E | 113 | 71 | 0 | 1 | 1 | 1 | 0 | 0 | 0 | 1 |
| OF | 106 | 6A | 0 | 1 | 1 | 0 | 1 | 0 | 1 | 0 |
| 10 | 100 | 64 | 0 | 1 | 1 | 0 | 0 | 1 | 0 | 0 |
| 11 | 95 | 5F | 0 | 1 | 0 | 1 | 1 | 1 | 1 | 1 |
| 12 | 89 | 59 | 0 | 1 | 0 | 1 | 1 | 0 | 0 | 1 |
| 13 | 84 | 54 | 0 | 1 | 0 | 1 | 0 | 1 | 0 | 0 |
| 14 | 80 | 50 | 0 | 1 | 0 | 1 | 0 | 0 | 0 | 0 |
| 15 | 75 | 4B | 0 | 1 | 0 | 0 | 1 | 0 | 1 | 1 |
| 16 | 71 | 47 | 0 | 1 | 0 | 0 | 0 | 1 | 1 | 1 |
| 17 | 67 | 43 | 0 | 1 | 0 | 0 | 0 | 0 | 1 | 1 |
| 18 | 63 | 3F | 0 | 0 | 1 | 1 | 1 | 1 | 1 | 1 |
| 19 | 60 | 3C | 0 | 0 | 1 | 1 | 1 | 1 | 0 | 0 |
| 1A | 56 | 38 | 0 | 0 | 1 | 1 | 1 | 0 | 0 | 0 |
| 1B | 53 | 35 | 0 | 0 | 1 | 1 | 0 | 1 | 0 | 1 |
| 1C | 50 | 32 | 0 | 0 | 1 | 1 | 0 | 0 | 1 | 0 |
| 1D | 47 | 2F | 0 | 0 | 1 | 0 | 1 | 1 | 1 | 1 |
| 1E | 45 | 2D | 0 | 0 | 1 | 0 | 1 | 1 | 0 | 1 |

In Table 1, the note data "01" corresponds to "La" in the lower octave in FIG. 8. The note data "12" corresponds to "Re" in the higher octave in FIG. 8. "Do" in the lower octave in FIG. 8 is defined by note data "04" where the frequency divided ratio is "201". Note data "10" defined by note data "04" plus "C" corresponds to the frequency divided data "100". This indicates that, when the note data are increased by "C", the frequency divided ratio is reduced by half so that the musical scale raises one octave in pitch.

Step ST7: The CPU 25 provides the n-bits (8 bits in this example) frequency divided ratio into the programmable counter 26 through output terminals D1 to D8 of the CPU 25. High level signals are inputted into the programmable counter 26 through the latch terminal LS of the CPU 25 to latch the 8-bits frequency divided data in the counter 26.

Step ST8: The reset terminal RS of the CPU 25 provides low level signals into the counter 26 so that the programmable counter 26 outputs the sound source frequency. After the sound source frequency is amplified by the amplifier 27, It is sounded by the speaker 28.

Figure 11:
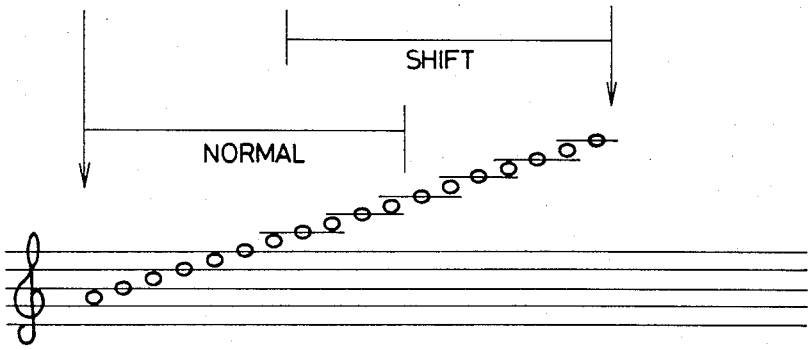
FIG. 11 shows a notation used in the electronic musical instrument of the present invention.

FIG. 11 shows a notation inclusive of a normal notation which the note key switches 1 can provide without actuation of the octave key 17 and a shifted notation which they provide with actuation of the octave key 17. The number of melodies capable of being played increases since the octave of the musical scales expands.

Figure 12:
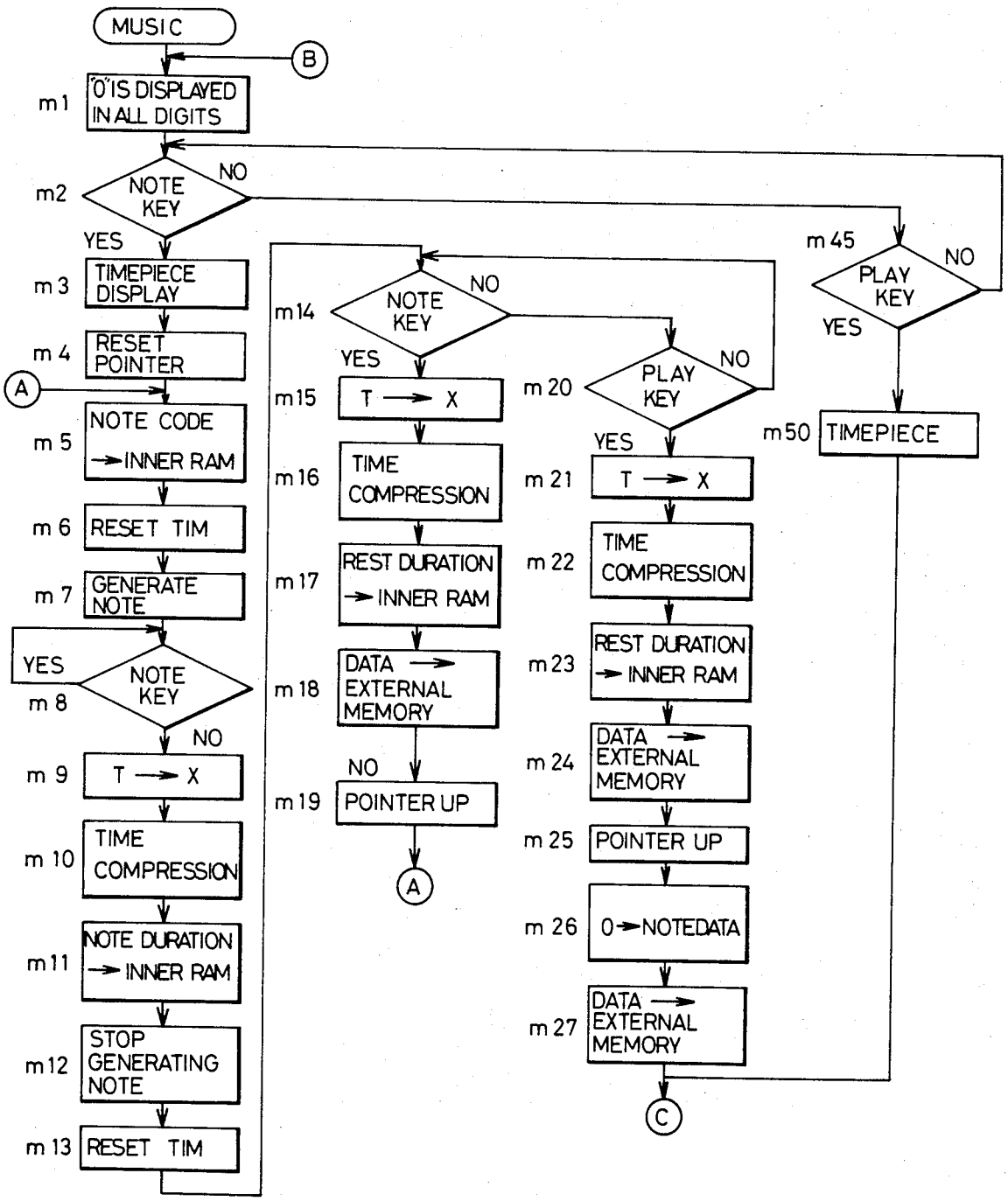
FIGS. 12 to 17 show a flow chart of operations according to the present invention.

(4) The musical information can be memorized in the memory with time compression:

FIG. 12 shows a flow chart of this operation. The mode selector 2 is placed at the playing mode of the electronic musical instrument mode to provide the following steps. Steps m1 to m8 of FIG. 12 are identical to those of FIG. 5.

Step m9: The output T from the timer TIM at this time is entered into the X register.

Step m10: The time compression as will be described below is conducted.

Step m11: The note duration data are inputted into the note buffer of the RAM.

Step m12: The note generation is terminated.

Step m13: The timer TIM is reset to count the rest duration data before one of note key switches 1 is actuated.

Step m14: A next one of the note key switches 1 is operated.

Step m15: The output T from the timer TIM at this time is inputted into the X register.

Step m16: The time compression is conducted.

Step m17: The rest duration data with the time compression are inputted into the rest duration buffer of the RAM. This indicates that the three kinds of data of the note, the note duration and the rest duration are all defined.

Step m18: These data are transferred into the external memory 8.

Step m19: The pointer is advanced by one for the following data transference.

Step m5 is re-selected so that steps m5 to m19 are repeated to play. After the key input operation is completed, the play key 5 is actuated to specify step m14→m20.

Step m21: A time T after the last note key switch 1 is non-actuated is inputted into the X register.

Step m22: The time compression is carried out to the rest duration data.

Step m23: The rest duration data with the time compression are entered into the rest duration buffer of the RAM.

Step m24: The rest duration data are transferred to the external memory 8.

Step m25: The pointer is advanced by one.

Step m26: An end code "0" is the note data to indicate the end.

Step m27: The end code is transferred to the external memory 8.

Figure 13:
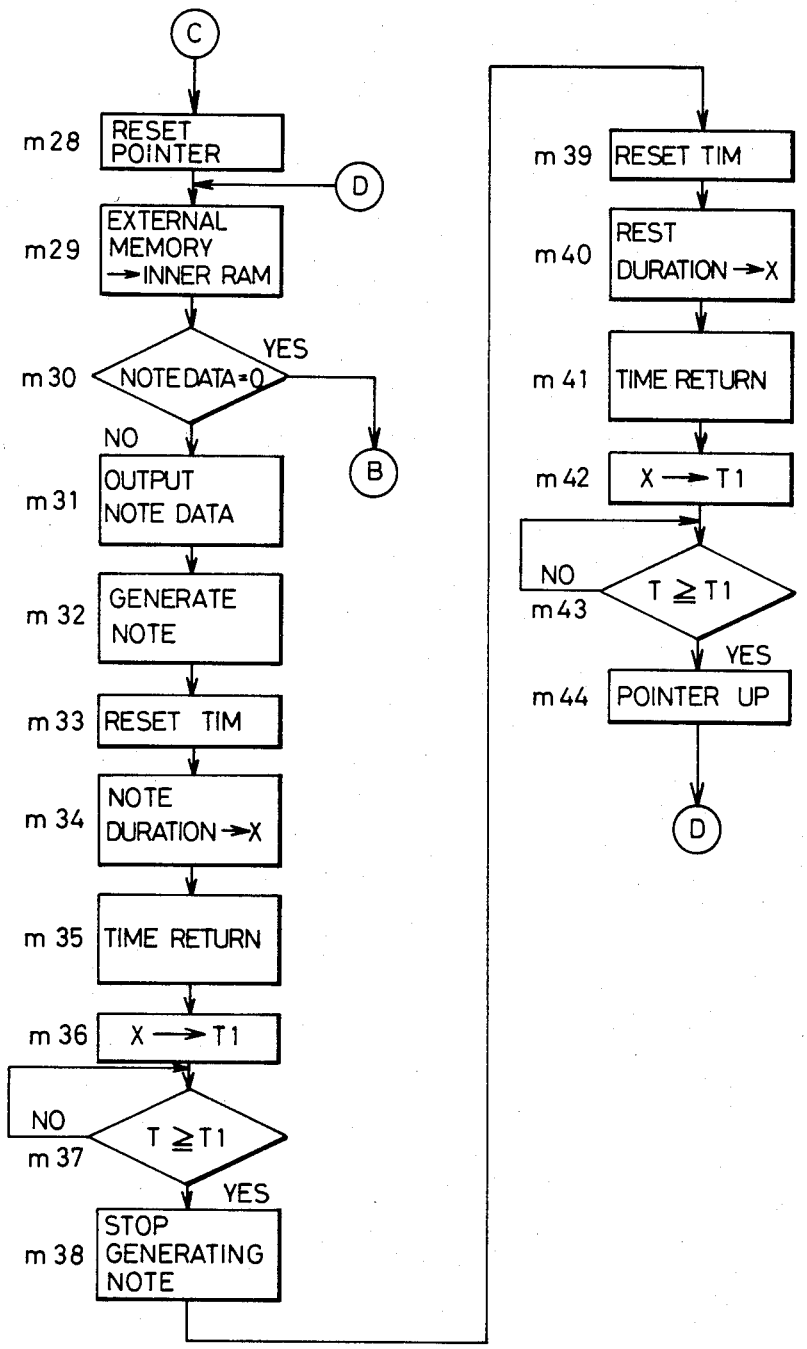

The playing operation as shown in FIG. 13 will follow.

Step m28: The pointer is reset to specify the head address of the external memory 8.

Step m29: The head address of the external memory 8 is read in to shelter in the external memory 8.

Step m30: It is detected whether the note data is "0". When it is "0", step m1 is re-selected to display "0" in all the display digits so as to indicate the termination of the playing. When it is not "0", step m31 is selected.

Step m31: The note code is entered to the note generators OG1 and OG2.

Step m32: The note corresponding to the note code is played.

Step m33: The timer TIM is reset.

Step m34: The note duration data are inputted to the X register.

Step m35: The time return as will be described below is conducted.

Step m36: The note duration data with the time return are inputted into a register TI.

Step m37: The output from the timer TIM and the note duration T1 are compared. When they agree, step m38 is specified.

Step m38: The note generation is stopped.

Step m39: The timer TIM is reset.

Step m40: The rest duration data are inputted into the X register.

Step m41: The rest duration data are processed for the time return.

Step m42: The rest duration data with the time duration are inputted into the register TI.

Step m43: The output from the timer TIM and the rest duration data of the register TI are compared. The note generation is stopped for the time corresponding to the rest duration data.

Step m44: The pointer is advanced by one.

Step m29 is re-selected. Steps m29 to m44 are repeated to play until the note data "0" is read in step m30.

When the display digits in the display 3 are all "0", the play key 5 is actuated to select steps m1→m2→m45. In step m50, the timepiece display for indicating the entry of playing is enabled. Step m28 is re-selected.

The time compression and the time return as described above are now explained. Table 2 shows a change of the time information for these operations.

TABLE

| before compression | after compression | after return |
|---|---|---|
| 00 | 00 | 00 |
| 01 | 01 | 01 |
| 02 | 02 | 02 |
| 03 | 03 | 03 |
| 04 | 04 | 04 |
| 05 | 05 | 05 |
| 06 | 06 | 06 |
| 07 | 07 | 07 |
| 08-09 | 08 | 08 |
| 0A-0B | 09 | 0A |
| 0C-0D | 0A | 0C |
| 0E-0F | 0B | 0E |
| 10-11 | 0C | 10 |
| 12-13 | 0D | 12 |
| 14-15 | 0E | 14 |
| 16-17 | 0F | 16 |
| 18-1B | 10 | 19 |
| 1C-1F | 11 | 1D |
| 20-23 | 12 | 21 |
| 24-27 | 13 | 25 |
| 28-2B | 14 | 29 |
| 2C-2F | 15 | 2D |
| 30-33 | 16 | 31 |
| 34-37 | 17 | 35 |
| 38-3F | 18 | 3B |
| 40-47 | 19 | 43 |
| 48-4F | 1A | 4B |
| 50-57 | 1B | 53 |
| 58-5F | 1C | 5B |
| 60-67 | 1D | 63 |
| 68-6F | 1E | 6B |
| 70-77 | 1F | 73 |
| 78-7F | 20 | 7B |
| 80-87 | 21 | 83 |
| 98-8F | 22 | 8B |
| 90-97 | 23 | 93 |

TABLE-continued

| before compression | after compression | after return |
|---|---|---|
| 98-9F | 24 | 9B |
| A0-A7 | 25 | A3 |
| A8-AF | 26 | AB |
| B0-B7 | 27 | B3 |
| B8-BF | 28 | BB |
| C0-C7 | 29 | C3 |
| C8-CF | 2A | CB |
| D0-D7 | 2B | D3 |
| D8-DF | 2C | DB |
| E0-E7 | 2D | E3 |
| E8-EF | 2E | EB |
| F0-F7 | 2F | F3 |
| F8- | 30 | F8 |

In Table 2, the respective values are represented in a hexadecimal notation. A counted value of "55" is compressed to be "1B" and is returned to be "53". When a reference time is 15 msec., for example, the time length of "00" to "07" before the time compression is backed to 0 to 0.1 seconds (15×07=105 msec.) without error which is outputted. The time length of "08" to "17" before the time compression is backed to 0.12 to 0.33 seconds in a maximum error ratio of ⅛(15×"16"=330 msec.).

The time length of "18" to "37" is backed to 0.37 to 0.8 seconds with the maximum error ratio of 2/25 (15×"35"=795 msec.). The time length of "38" to "F7" is backed to 0.88 to 3.6 seconds with the maximum error ratio 4/59 (15×"F3"=3645 msec.). The time legnth more than "F8" before the time compression is all backed to "FB", 3.76 secons (15×"FB"=3765 msec.).

Figure 14:
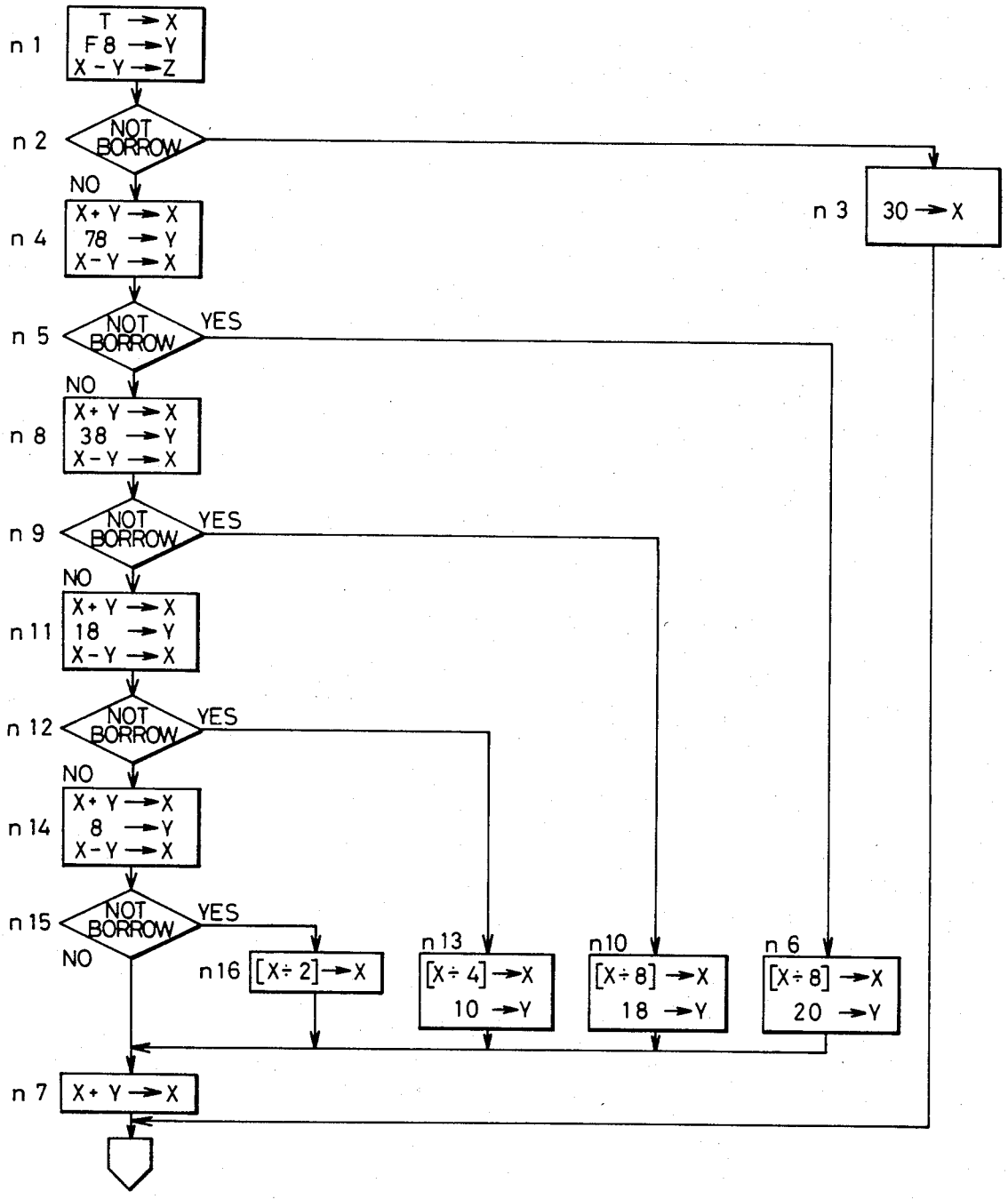

FIG. 14 shows a flow chart for explaining the time compression operation where all the calculation is held under the hexadecimal notation.

Step n1: The output T from the timer TIM is inputted into the X register. "F8" is inputted into the Y register. A subtraction of the X register contents minus the Y register contents is inputted into the X register. When no borrowing is necessary in this calculation, namely, T≧F8, step n3 is selected. When borrowing is necessary, namely, T<F8, step n2 is selected.

Step n3: The uppermost value "30" is inputted into the X register.

Step n4: The X register contents and the Y register contents are added to get "X+Y". The results are inputted into the X register. After the contents of the X register are returned, "78" is inputted into the Y register. "X−Y" is calculated. When no borrowing is necessary, namely, "T≧78", steps n5→n6 are selected.

Step n6: Using the X register contents in step n4, a division of "X÷8" is carried out so that an integer only of the results is inputted into the x register. In FIG. 14, round brackets "[ ]" indicate Gauss' notation. "20" is inputted into the Y register.

Step n7: "X+Y" is obtained which is inputted into the X register.

Step n8: When borrowing is necessary in step n5 because of "T<78", step n8 is selected. "X+Y" is calculated. "38" is inputted into the Y register. "X−Y" is calculated.

Thus, through steps n9→n16, the Y register successively receives "F8", "78", "38", "18" and "8" to branch. When the timer T1M outputs "55" as T, in step 8, "55-38" is calculated to obtain "1B" which is inputted into the X register.

Step n10: "[X÷8] is calculated to input "3" into the X register. "18" is inputted into the Y register.

Step n7: Finally, the X register contains "1B".

Figure 15:
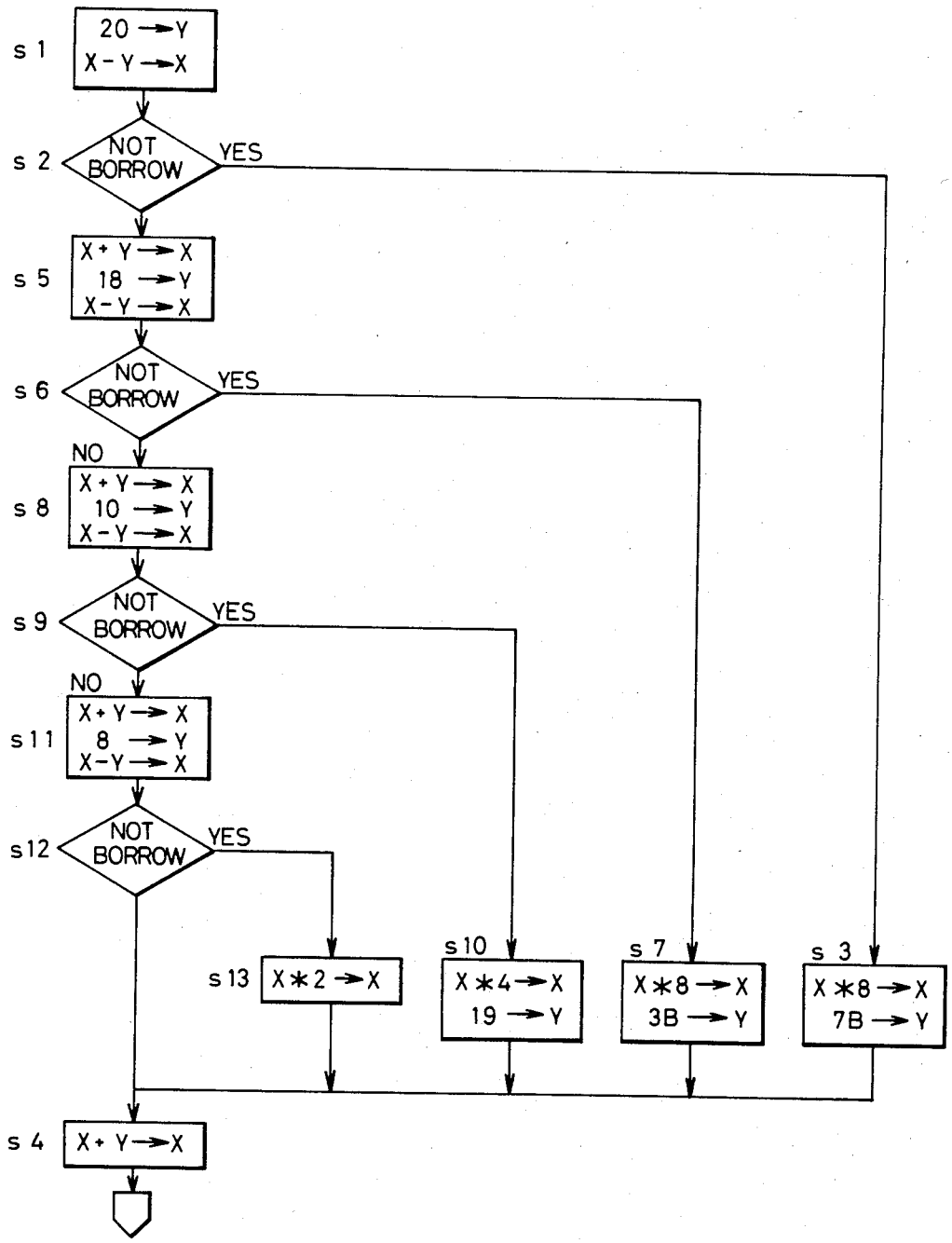

FIG. 15 shows a flow chart for explaining the time return operation.

Step S1: The compression value is inputted into the X register. "20" is inputted into the Y register. "X−Y" is calculated and the results are inputted into the X register. When borrowing is necessary because of "≧20", steps S2 to S3 are selected.

Step S3: "X×8" is calculated to input the results into X register. "7B" is inputted into the Y register.

Step S4: "X+Y" is calculated to input the results into the X register. Then, the time return operation is completed.

Step S5: When borrowing is necessary in step S2 because of "X<20", "X+Y" is calculated in step S5 to input the results into the X register. After the contents of the X register are returned, "10" is inputted into the Y register. "X−Y" is calculated to input the results into the Y register.

Thus, through steps S6 to S13, the Y register successively receives "18", "10" and "8" to branch. When the compression value is "1B", steps S6→S7 are selected in which the X register contains "4" based on the calculation of "1B-18". In step S7, a product of "X×8" is calculated to input the results of "20" into the X register. In step S4, an addition of the X register contents plus "3B" in the Y register is calculated to input the results of "5B" into the X register. Thus, the time return is completed.

As stated above, the time information is compressed are returned. Only 6 bits are needed to store the time information according to the present invention. Otherwise, 8 bits were needed in the conventional device to store the same time information.

Figure 16:
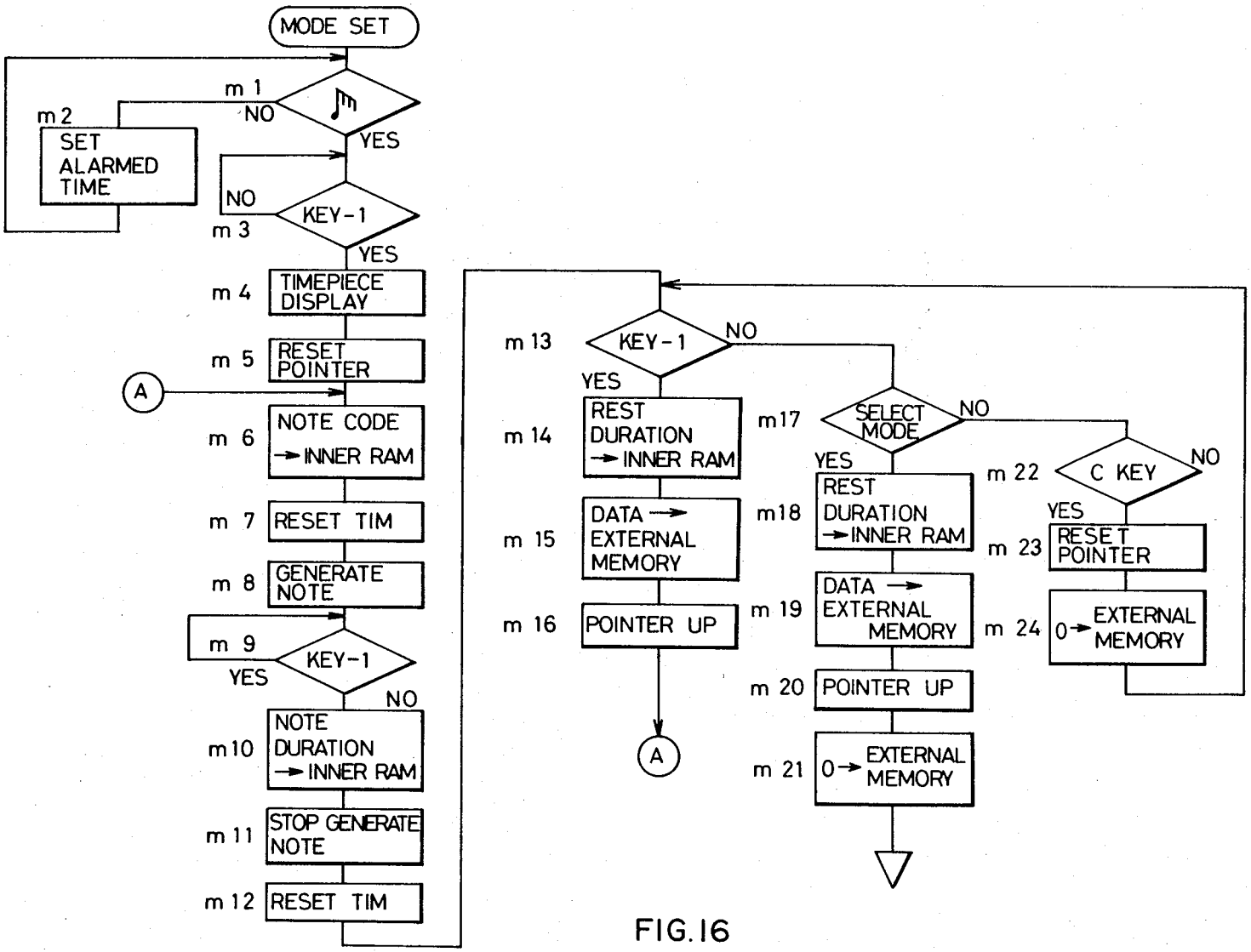

(5) When it is the alarm time, the fixed melody in the memory and the voluntary melody newly inputted into the memory are selectively outputted:

FIG. 16 shows a flow chart of operation for setting the alarm time and for inputting the voluntary melody. To set the alarm time, the mode selector 2 is placed at the setting mode referred to "SET" in FIG. 1.

Step m2: Either of the first alarm key switch 13 and the second alarm key switch 14 is actuated to set the alarm time. When the play key 5 is not actuated in step m1, step m2 is selected. In step m2, "7", "3", "0", "AM.PM" and "ALM1" are key inputted to set the first alarm time of "PM 7:30". The first alarm time is set in a register AT1. It may be possible to set the second alarm time in step m2 where the second alarm time is set in another register AT2.

To input the voluntary melody which is to be played at the first alarm time, the play key 5 is actuated in step m1. In step m3, any of the note key switches 1 is actuated. Steps m3 to m12 of FIG. 16 are identical to steps m2 to m11 of FIG. 5.

Step m13: A next note key switch 1 is actuated.

Step m14: The output from the timer TIM at this time is inputted into the rest duration buffer of the RAM. Then, three types of data inclusive of the note code, the note duration and the rest duration are supplied.

Step m15: These three tupes of data are transferred into the external memory 8.

Step m16: The pointer is advanced by one for the following data transference.

Step m6 is re-selected and, thereafter, steps m6 to m16 are repeated to input the voluntary melody.

When the mode selector 2 is separated from the setting mode (SET), steps m13→m17→m18 are selected.

Step m18: The rest duration data are transferred into the buffer in the RAM.

Step m19: The three kinds of data of the note code, the note duration and the rest duration are transferred into the external memory 8.

Step m20: The pointer is advanced by one.

Step m21: "0" is applied to the external memory 8 so that the data code becomes the END code. Then, the entry of the voluntary melody is terminated.

To cancel the voluntary melody already stored in the memory, the mode selector is placed at the setting mode (SET) in which the play key 5 and the clear key 18 are actuated. Steps m22→m23 are selected.

Step m23: The pointer is reset.

Step m24: "0" as the END code is entered into the head address of the external memory 8 so as to cancel the voluntary melody already stored in the memory 8.

Figure 17:
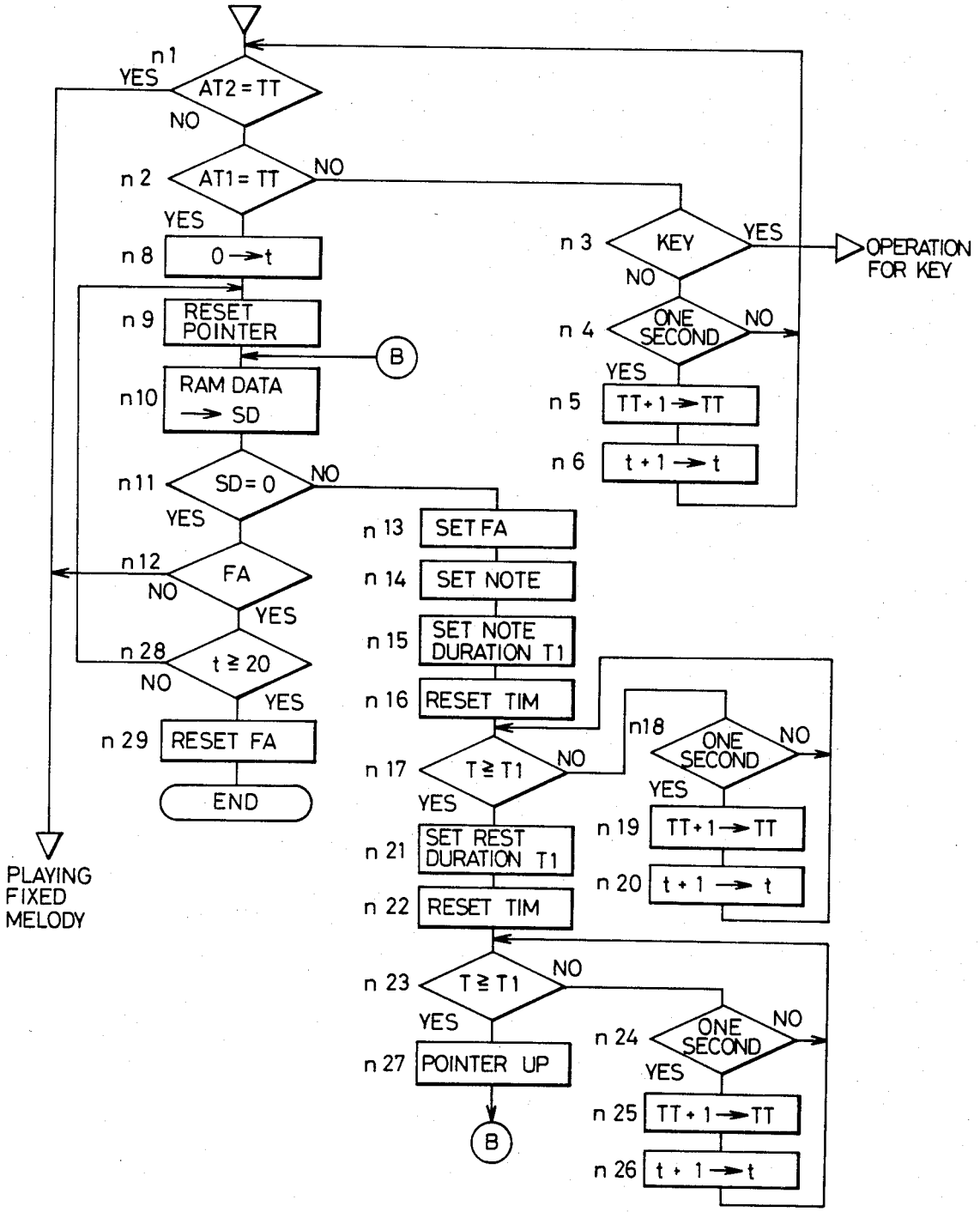

FIG. 17 shows a flow chart of alarming operation. The first alarm time and the second alarm time are each set in the registers AT1 and AT2.

Step n1: It is detected whether the contents of the register TT for storing current time information are identical with those of the register AT2.

Step n2: The contents of the register TT and those of the register AT1 are compared.

Step n3: It is detected whether any one of the note key switches 1 is actuated.

Step n4: Each time one-second information is generated, step m5 is selected.

Step n5: The register TT is counted up by one second.

Step n6: A timer t is counted up by one second.

Step n1 is re-selected. Steps n1 to n6 are repeated.

When the second alarm time comes in step n1, step n7 is selected where the fixed melody already stored in the ROM is played. This alarming operation is the same as that of the voluntary melody as will be described below.

Step n2: The first alarm time comes.

Step n8: The timer t is reset

Step n9: The pointer is reset.

Step n10: The head data of the voluntary melody presently entered is transferred into the buffer SD Step n11: When the head data are "0" indicating that the voluntary melody is canceled, step n12 is selected.

Step n12: Unless a flag FA is set, step n7 is re-selected where the fixed melody is played. That is, when the voluntary melody is not set, the fixed melody is played even when the first alarm time comes.

Step n13: When it is detected in step n11 that the head data transferred to the buffer SD are not "0", step n13 is selected. The flag FA is set for indicating that the voluntary melody is set.

Step n14: The note codes are outputted into the note generators OG1 and OG2.

Step n15: The note duration data are transferred into the register T1.

Step n16: The timer TIM is reset and the note corresponding to the note code is being played for the time defined by the note duration data. Steps n18→n18→n19→n20→n17 are repeated so that the note is being played until the output T from the timer T1M agrees to the contents of the register T1.

Step n21: The rest duration data are transferred to the register T1.

Step n22: The timer TIM is reset.

Step n23→n24→n25→n26→n23 are repeated so that the note generation is prohibited for the time defined by the rest duration data.

Step n27: The pointer is advanced by one.

Step n10 is re-selected for the following note generation.

Thus, the voluntary melody is played.

When the last data or the END code of the voluntary melody is outputted in step n11, step n12 is selected. Since it is found in step n12 that the flag FA is set in step n13, step n28 is selected. In step n28, it is detected whether a predetermined time, e.g., 20 seconds, lapse from the alarm start time. That is, the counted number of the timer t is found to be more than 20. When it is less than 20, step n9 is re-selected where the voluntary melody is repeatedly played. It is assumed that the voluntary melody continues for 15 seconds. 30 seconds lapse when this melody is twice repeated. At that time, steps n28→n29 are selected. In step n29, the flag FA is reset to terminate the alarming operation. In case where the voluntary melody has 6-second length, the melody is repeated four times before the alarming operation is terminated. The invention being thus described, it will be obvious that the same may be varied in many ways. Such variations are not to be regarded as a departure from the spirit and scope of the invention, and all such modifications are intended to be included within the scope of the following claims:

What is claimed is:

1. A combined timepiece, calculator and electronic musical instrument comprising:

key input means including time function key means for controlling said timepiece, calculation function key means for operating said calculator and musical note key means for generating musical notes, the latter comprising individual note keys;

mode selection means for selecting time, calculation and musical modes for said instrument;

memory means in said instrument for receiving and storing the respective musical notes produced by the individual note keys of said musical note key means; and clear means comprising a clear entry key in said calculation function key means, responsive to said mode selection means in said musical mode of said instrument, actuable to amend at least one of the notes contained in said memory means.

2. The combined timepiece, calculator and electronic musical instrument of claim 1, wherein the clear means is actuated to amend said at least one of the notes from the memory means while the notes are played.

3. The combined timepiece, calculator and electronic musical instrument of claim 1, further comprising replacing means for replacing at least one of the notes canceled by said clear means with new note information.

4. The combined timepiece, calculator and electronic musical instrument of claim 1, wherein:

said individual note keys are aligned like a pianoforte keyboard; and said memory means includes means for storing codes allotted to the respective musical scales and note generation frequency data inputted to said memory means in response to actuation or corresponding ones of said individual note keys; and which further includes:

generation means responsive to actuation of the individual note keys and said note generation frequency data for generating musical notes corresponding to the codes defined by said note generation frequency data inputted by said individual note keys; and octave shifting means for shifting the codes and notes corresponding thereto by at least one octave.

5. The combined timepiece, calculator and electronic musical instrument of claim 1, which further comprises:

generation means responsive to the actuation of said individual note keys providing information corresponding to said respective musical notes; and time compression means responsive to said information provided from said generation means for causing time compression of said information to be stored in said memory means;

said memory means receiving and storing said time compressed information corresponding to said respective musical notes.

6. The combined timepiece, calculator and electronic musical instrument of claim 5, further comprising time return means for causing time return upon said time compressed information stored in said memory means.

7. The combined timepiece, calculator and electronic musical of claim 1, wherein said clear means acts to amend that respective note stored in said memory means by an actuation of said key input means just preceding actuation of said clear means.

8. The combined timepiece, calculator and electronic musical instrument of claim 7, wherein N successive actuations of said clear means act to amend the Nth next preceding note to the first actuation of said clear means, N being a whole number.

* * * * *